US006051543A

United States Patent [19]

Tarng et al.

[11] Patent Number: 6,051,543

[45] Date of Patent: Apr. 18, 2000

[54] LIGHT DUTY LIQUID CLEANING COMPOSITIONS CONTAINING A SALTING IN AND SALTING OUT SALT

[75] Inventors: Jiashi Tarng, Dayton; Ammanuel Mehreteab, Piscataway, both of N.J.

[73] Assignee: Colgate-Palmolive Co., Piscataway, N.J.

[21] Appl. No.: 09/022,579

[22] Filed: Feb. 12, 1998

Related U.S. Application Data

[63] Continuation-in-part of application No. 08/687,238, Jul. 25, 1996, abandoned.

[51] Int. Cl.[7] ..... C11D 17/00

[52] U.S. Cl. ..... 510/428; 510/426; 510/427; 510/238; 510/241

[58] Field of Search ..... 510/426, 427, 510/428, 429, 238, 241

[56] References Cited

U.S. PATENT DOCUMENTS

| | | | |
|---|---|---|---|
| 5,565,421 | 10/1996 | Aszman et al. | 510/403 |
| 5,616,548 | 4/1997 | Thomas et al. | 510/242 |
| 5,672,580 | 9/1997 | Donker et al. | 510/417 |
| 5,733,860 | 3/1998 | Durbut et al. | 510/405 |

FOREIGN PATENT DOCUMENTS

| | | |
|---|---|---|
| 0079646 | 5/1983 | European Pat. Off. . |

*Primary Examiner*—Necholus Ogden
*Attorney, Agent, or Firm*—Richard E. Nanfeldt

[57] ABSTRACT

A light duty liquid detergent with desirable cleansing properties and mildness to the human skin comprising: a sodium salt of a sulfonate surfactant, an alkali metal or ammonium salt of a $C_{8-18}$ ethoxylated alkyl ether sulfate anionic surfactant, a salting-in salt, a salting-out salt, and water.

5 Claims, No Drawings

LIGHT DUTY LIQUID CLEANING COMPOSITIONS CONTAINING A SALTING IN AND SALTING OUT SALT

RELATED APPLICATION

This application is a continuation in part application of U.S. Ser. No. 8/687,238 filed Jul. 25, 1996 now abandoned.

FIELD OF THE INVENTION

This invention relates to a light duty liquid cleaning composition having an apparent viscosity at 3 times dilution in deionized water at a shear rate of 20 $sec^{-1}$ at 25° C. of about 300 to about 700 cps and at 4 times dilution in deionized water at a shear rate of 20 $sec^{-1}$ at 25° C. of about 150 to about 350 cps and is designed in particular for dishware and is effective in removing grease soil and in leaving unrinsed surfaces with a shiny appearance.

BACKGROUND OF THE INVENTION

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surface or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to about 18% by weight of the aqueous phase), the presence of such high quantities of grease-removal solvent tend to reduce the total amount of greasy or oily soils which can be taken up by and into the microemulsion without causing phase separation.

The present invention relates to novel light duty liquid detergent compositions having an apparent viscosity at 3 times dilution in deionized water at shear rate of 20 $sec^{-1}$ at 25° C. of about 300 to about 700 cps and at 4 times dilution in deionized water at a shear rate of 20 $sec^{-1}$ at 25° C. of about 150 to about 350 cps and high foaming properties which comprises a sulfonate surfactant, a sodium salt of an ethoxylated alkyl ether sulfate surfactant, a salting-in salt, a salting-out salt and water.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,671,895 teaches a liquid detergent composition containing an alcohol sulfate surfactant, a nonionic surfactant, a paraffin sulfonate surfactant, an alkyl ether sulfate surfactant and water.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monethanolamide foam stabilizer.

However, none of the above-cited patents discloses a liquid detergent composition having at 3 times dilution in deionized water and at an apparent viscosity at 25° C., of about 300 to about 700 cps which comprises an alkali metal salt of an alkyl benzene sulfonate surfactant, an alkali metal salt of an ethoxylated alkyl ether sulfate surfactant, a salting-in salt, a salting-out salt and water, wherein the composition does not contain any amine oxide, betaine surfactant, nonionic surfactant low molecular weight mono- or di-glucoside, abrasives, silicas, alkaline earth metal carbonates, alkyl glycine surfactant, cyclic imidinium surfactant, alkali metal carbonates or more than 3 wt. % of a fatty acid or its salt thereof.

SUMMARY OF THE INVENTION

This invention relates to a light duty liquid composition having at 3 times dilution in deionized water and at an apparent viscosity at 25° C. of about 300 to about 700 cps and at 4 times dilution in deionized water at a shear rate of 20 $sec^{-1}$ at 25° C. of about 150 to about 350 cps which has desirable cleaning properties together with mildness to the human skin.

An object of this invention is to provide a novel light duty liquid detergent composition having at 3 times dilution in deionized water and at an apparent viscosity at 25° C. of about 300 to about 700 cps which comprises an alkali metal salt of an alkyl benzene sulfonate surfactant, an alkali metal salt of an ethoxylated alkyl ether sulfate surfactant, a salting-in salt, a salting-out salt and water, wherein the composition does not contain any amine oxide, nonionic surfactant, betaine surfactant, silicas, abrasives, alkali metal carbonates, alkaline earth metal carbonates, alkyl glycine surfactant, cyclic imidinium surfactant, low molecular weight mono- or di-glucoside or more than 3 wt. % of a fatty acid or salt thereof.

Another object of this invention is to provide a novel light duty liquid detergent with desirable high foaming and cleaning properties which is mild to the human skin.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein the novel, high foaming light duty liquid detergent of this invention comprises two essential surfactants: an alkali metal salt of an ethoxylated alkyl ether sulfate surfactant and an alkali metal, a salt of an alkyl benzene sulfonate surfactant, wherein the composition does not contain any amine oxide, nonionic surfactant, silicas, abrasives, alkali metal carbonates, alkaline earth metal carbonates, alkyl glycine surfactant, cyclic imidinium surfactant or more than 3 wt. % of a fatty acid or salt thereof.

DETAILED DESCRIPTION OF THE INVENTION

The flowable concentrated light duty liquid compositions of the instant invention having an apparent viscosity at 25° C. at 3 times dilution undeionized water at a shear rate of 20 $sec^{-1}$ of about 300 to 700 cps comprises approximately by weight:

(a) 4% to 10%, more preferably 5% to 9% of an alkali metal salt of a $C_{8-18}$ ethoxylated alkyl ether sulfate;

(b) 26% to 40%, more preferably 28% to 36% of a sodium salt of a linear alkyl benzene sulfonate surfactant wherein the ratio of sulfonate surfactant to the ethoxylated alkyl ether sulfate is about 10:1 to 3:1, more preferably about 6:1 to 3:1, most preferably about 4:1;

(c) 1% to 8%, more preferably 2% to 7% of a salting-in salt;

(d) 0.5% to 5%, more preferably 1% to 4% of a salting-out salt;

(e) 0 to 1.2% of a perfume; and (f) the balance being water, wherein the composition at 25° C. at 3 times dilution in deionized water has an apparent viscosity of about 300 to about 700 cps, more preferably about 350 to about 650 cps and the concentrated light duty liquid composition has a concentration prior to dilution in excess of 1,000 cps as measured at 25° C. at a shear rate of 20 $sec^{-1}$.

The $C_{8-18}$ ethoxylated alkyl ether sulfate surfactants used in the instant composition have the structure $$R—(OCHCH_2)_nOSO^-_3{}^{M^+}$$

wherein n is about 1 to about 22 more preferably 1 to 3 and R is an alkyl group having about 8 to about 18 carbon atoms, more preferably 12 to 15 and natural cuts, for example, $C_{12-14}$; $C_{12-15}$ and M is an alkali metal cation, most preferably sodium. The ethoxylated alkyl ether sulfate is present in the composition at a concentration of about 4 wt. % to about 10 wt. %, more preferably about 5 wt. % to 9 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

A linear alkyl benzene sulfonates containing from 10 to 16 carbon atoms in the alkyl group is used in the instant compositions wherein the alkyl benzene sulfonates have a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position.

This sulfonate surfactant is preferably a sodium salt of a $C_{10}$–$C_{16}$ linear alkyl benzene sulfonate used at a concentration of about 26 wt. % to about 40 wt. %, more preferably about 28 wt. % to about 36 wt. % in the instant compositions.

The instant composition contains about 4 wt. % to about 12 wt. %, more preferably about 5 wt. % to about 10 wt. % of a mixture of a salting-in salt and a salting-out salt. The concentration of the salting-in salt is about 1.5 wt. % to about 8.5 wt. %, more preferably about 2 wt. % to about 8 wt. %. The concentration of the salting-out salt is about 0.5 wt. % to about 4 wt. %, more preferably about 1 wt. % to about 3.5 wt. %. The salting-in salt is selected from the group consisting of alkali metal sulfate and alkaline earth metal sulfate such as sodium sulfate and magnesium sulfate. The salting-out salt is selected from the group consisting of alkali metal halides, and alkaline earth metal halides and mixtures thereof such as sodium chloride, sodium bromide, magnesium chloride.

The instant compositions optionally contain 0 to 1.2 wt. %, more preferably 0.6 wt. % to 1.2 wt. % of a perfume such as those perfumes described in U.S. Pat. No. 5,076,954 or U.S. Pat. No. 5,108,643 which is hereby incorporated by reference.

The instant compositions can also contain about 0 wt. % to about 6 wt. %, more preferably about 1 wt. % to about 5 wt. % of a $C_{12}$–$C_{14}$ alkyl dialkanol amide and/or $C_{12}$–$C_{14}$ alkyl monoalkanol amide such as lauryl monoalkanol amide (LMMEA).

The instant compositions can also contain about 0 wt. % to about 12 wt. %, more preferably about 1 wt. % to about 10 wt. %, of at least one solubilizing agent which can be sodium xylene sulfonate, sodium cumene sulfonate, a $C_{2-3}$ mono or dihydroxy alkanols such as ethanol, isopropanol and propylene glycol and mixtures thereof. The solubilizing agents can be included in order to control low temperature cloud clear properties. Urea can be optionally employed in the instant composition as a supplemental solubilizing agent at a concentration of 0 to about 10 wt. %, more preferably about 0.5 wt. % to about 8 wt. %.

Other solubilizing agents are glycerol, water-soluble polyethylene glycols having a molecular weight of 300 to 600, polypropylene glycol of the formula $HO(CH_3CHCH_2O)_nH$ wherein n is a number from 2 to 18, mixtures of polyethylene glycol and polypropylene glycol (Synalox) and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate.

The instant formulas explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned. The instant compositions are not microemulsion compositions and to prevent the formation of a microemulsion the composition does not contain more than 0.2 wt. % of a perfume, essential oil or water insoluble hydrocarbon or water insoluble organic compound having a $\sigma_H$ of about 0 to about 12 $(MPa)^{1/2}$, $\sigma_d$ of about 14 to about 19 $(MPa)^{1/2}$, and a $\sigma_p$ of about 0 to about 6 $(MPa)^{1/2}$, or d-limonene. The final essential ingredient in the inventive compositions having improved interfacial tension properties is water.

In final form, the instant compositions exhibit stability at reduced and increased temperatures. More specifically, such compositions remain clear and stable in the range of 5° C. to 50° C., especially 10° C. to 43° C. The instant compositions have a light transmission of at least 95%. Such compositions exhibit a pH of 5 to 8. The liquid compositions are readily pourable and exhibit an apparent viscosity at 25° C. at 3 times dilution in deionized water at a shear rate of 20 $sec^{-1}$ in the range of 300 to 700 cps, more preferably about 350 to about 650 cps. Preferably, the viscosity is maintained in the range of 300 to 500 cps. The instant compositions have a minimum foam height of 110 mls after 55 rotation at 40° C. as measured by the foam volume test using 0.75 grams of the composition per liter of water and 1 gram of corn oil per liter of water having a hardness of 300 ppm.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following composition in wt. % was prepared by simple mixing procedure at 25° C.:

| | A | B | C | D | E | F | G | H |
|---|---|---|---|---|---|---|---|---|
| Sodium salt of a $C_{10}$–$C_{16}$ linear alkyl benzene sulfonate | 32 | 32 | 32 | 32 | 32 | 32 | 32 | 16 |
| Sodium AEOS (2EO) | 8 | 8 | 8 | 8 | 8 | 8 | 8 | 16 |
| NaBr | 1.5 | 1.75 | 2.0 | 2.25 | 2.25 | 2.5 | 2.5 | 2.5 |
| $Na_2SO4$ | 6 | 6.25 | 6 | 5.75 | 5.75 | 6 | 6 | 6 |
| NaCl | | | | | | | | |
| MgSO4 | | | | | | | | |
| MgCl2 | | | | | | | | |
| Perfume | | | | | 1 | | 1 | |
| Water | Bal. | Bal. | Bal. | Bal. | Bal. | Bal. | Bal. | Bal. |
| n' cps | 315 | 393 | 398 | 384 | 416 | 445 | 437 | |

n' apparent viscosities at 25° C. at 3 times dilutions with deionized water at shear rate of 20/1 sec.

| | I | J | K | L | M |
|---|---|---|---|---|---|
| Sodium salt of a $C_{10}$–$C_{16}$ linear alkyl benzene sulfonate | 32 | 32 | 32 | 32 | 32 |
| Sodium AEOS (2EO) | 8 | 8 | 8 | 8 | 8 |
| NaBr | | | | 4 | |
| $Na_2SO4$ | 6 | 8.25 | 6.5 | | |
| NaCl | | | 1.5 | | |
| MgSO4 | | | | 4 | 2 |
| MgCl2 | 2 | 1.75 | | | 2 |
| Perfume | | | | | |
| Water | Bal. | Bal. | Bal. | Bal. | Bal. |
| n' cps | 690 | 730 | 491 | 617 | 533 |

n' apparent viscosities at 25° C. at 3 times dilutions with deionized water at shear rate 20 sec−1.

| | N | O | P | Q | R | S | T | U |
|---|---|---|---|---|---|---|---|---|
| Sodium salt of a $C_{10}$–$C_{16}$ linear alkyl benzene sulfonate | 36 | 32 | 32 | 32 | 32 | 32 | 32 | 32 |
| Sodium AEOS (2EO) | 12 | 8 | 8 | 8 | 8 | 8 | 8 | 8 |
| NaBr | 2.5 | | | 4 | | | | |
| $Na_2SO4$ | 6 | 8.25 | 8 | | | | | |
| NaCl | | | | | 2.75 | 3 | 3 | 3.25 |
| MgSO4 | | | | 4 | 4.25 | 4 | 4 | 3.75 |
| MgCl2 | | 1.75 | 2 | | | | | |
| Perfume | | | 1 | | | | 1 | 1 |
| Water | Bal. | Bal. | Bal. | Bal. | Bal. | Bal. | Bal. | Bal. |
| n' cps | | 189 | 196 | 161 | 213 | 212 | 235 | 217 |

n' apparent viscosities at 25° C. at 4 times dilutions with deionized water at shear rate of 20 sec−1.

| | V | W | X | Y | Z | AA |
|---|---|---|---|---|---|---|
| Sodium salt of a $C_{10}$–$C_{16}$ linear alkyl benzene sulfonate | 32 | 32 | 32 | 32 | 32 | 32 |

-continued

| | | | | | | |
|---|---|---|---|---|---|---|
| Sodium AEOS (2EO) | 8 | 8 | 8 | 8 | 8 | 8 |
| NaBr | | | | | | |
| $Na_2SO4$ | | | | | | |
| NaCl | 3.25 | 3.5 | 3.5 | 3.75 | 3.75 | 3.75 |
| MgSO4 | 4.75 | 4.5 | 4.5 | 4.25 | 5.25 | 5.25 |
| $MgC_{12}$ | | | | | | |
| Perfume | | | 1 | 1 | | 1 |
| Water | Bal. | Bal. | Bal. | Bal. | Bal. | Bal. |
| n' cps | 282 | 264 | 234 | 252 | 321 | 240 |

n' apparent viscosities at 25° C. at 4 times dilutions with deionized water at shear rate of 20 sec−1.

The viscosity measurements were carried out by Carri-Med CSL-100 Rheometer at 25° C. The type of system was "Cone and Plate". A 4.0 cm cone with 2 degree angle and 57 micro meter gap was employed.

What is claimed:

1. A clear concentrated cleaning composition consisting of approximately by weight:

(a) 4% to 10% of an alkali metal salt of a $C_{8-18}$ ethoxylated alkyl ether sulfate;

(b) 26% to 40% of a sodium salt of a $C_{10}$–$C_{16}$ alkyl benzene sulfonate surfactant;

(c) 1% to 8% of a salting-in salt which is selected from the group consisting of sodium sulfate and magnesium sulfate;

(d) 0.5% to 4% of a salting-out salt which is selected from the group consisting of sodium chloride, sodium bromide, magnesium chloride and mixtures thereof;

(e) 1% to 10% of at least one solubilizing agent; and (f) the balance being water, wherein the composition at 25° C. has an apparent viscosity at 3 times dilution in deionized water at a shear rate of 20 $sec^{-1}$ of about 300 cps to about 700 cps and at 4 times dilution in deionized water at a shear rate of 20 $sec^{-1}$ at 25° C. of about 150 to about 350 cps and a minimum foam height of 110 mls at 40° C. after 55 rotations.

2. The composition of claim 1, wherein said solubilizing agent is a $C_{2-3}$ mono or dihydroxy alkanol.

3. The composition of claim 1, wherein said solubilizing agent is selected from the group consisting of isopropanol, ethanol and propylene glycol and mixtures thereof.

4. The composition of claim 1, wherein said solubilizing agent is selected from the group consisting of glycerol, polyethylene glycols, polypropylene glycol of the formula $HO(CH_3)CHCH_2O)_nH$, wherein n is 2 to 18, mono $C_1$–$C_6$ alkyl ethers and esters of ethylene glycol and propylene glycol having the formulas of $R(X)_nOH$ and $R_1(X)_nOH$ wherein R is a $C_{1-6}$ alkyl group, $R_1$ is a $C_{2-4}$ acyl group, X is $(OCH_2CH_2)$ or $(OCH_2CHCH_3)$ and n is from 1 to 4.

5. The composition of claim 1, wherein said solubilizing agent is sodium xylene sulfonate or sodium cumene sulfonate.

* * * * *